United States Patent [19]

Olson

[11] Patent Number: 4,830,773

[45] **Date of Patent: * May 16, 1989**

[54] ENCAPSULATED BLEACHES

[75] Inventor: Keith E. Olson, Apple Valley, Minn.

[73] Assignee: Ecolab Inc., St. Paul, Minn.

[ * ] Notice: The portion of the term of this patent subsequent to Mar. 15, 2005 has been disclaimed.

[21] Appl. No.: 71,788

[22] Filed: Jul. 10, 1987

[51] Int. Cl.[4] ..... C11D 17/00

[52] U.S. Cl. ..... 252/174.13; 252/91; 252/99; 252/174; 252/186.25; 252/186.35; 252/186.36; 252/186.37

[58] Field of Search ..... 252/99, 186.25, 186.35

[56] References Cited

U.S. PATENT DOCUMENTS

| | | | |
|---|---|---|---|
| 3,154,494 | 10/1964 | Speak et al. | 252/96 |
| 3,637,509 | 1/1972 | Brennan et al. | 252/99 |
| 3,650,961 | 3/1972 | Hudson | 252/99 |
| 3,703,470 | 11/1972 | Brennan | 252/99 |
| 3,908,045 | 9/1975 | Alterman et al. | 427/213 |
| 3,983,254 | 9/1976 | Alterman et al. | 428/403 |
| 4,009,113 | 2/1977 | Green et al. | 252/95 |
| 4,279,764 | 7/1981 | Brubaker | 252/99 |
| 4,473,620 | 9/1984 | Wu et al. | 428/402.24 |
| 4,569,780 | 2/1986 | Fernholz et al. | 252/90 |
| 4,569,781 | 2/1986 | Fernholz et al. | 252/92 |
| 4,657,784 | 4/1987 | Olson | 427/213 |
| 4,731,195 | 3/1988 | Olson | 252/99 |

OTHER PUBLICATIONS

Hercules ® Technical Bulletin "Cellulose Gum".
Hercules ® Technical Bulletin "Klucel Hydroxypropylcellulose".
Hercules ® Technical Bulleting "Natrosol ® Hydroxyethylcellulose".

*Primary Examiner*—Paul Lieberman
*Assistant Examiner*—John F. McNally
*Attorney, Agent, or Firm*—Merchant, Gould, Smith, Edell, Welter & Schmidt

[57] ABSTRACT

Stable encapsulated bleach comprising a core of bleaching agent such as an alkaline metal salt of chloroisocyanurate, an inner coating of a chemically compatable separating compound such as sodium sulfate, sodium tripolyphosphate and mixtures thereof, and an outer coating of a water soluble cellulose ether such as hydroxyethyl and hydroxypropyl celluloses.

17 Claims, No Drawings

ENCAPSULATED BLEACHES

FIELD OF THE INVENTION

This invention relates to encapsulated bleaching agents having improved bleach stability in alkaline environments.

BACKGROUND OF THE INVENTION

Bleaches are a well known group of chemical agents having the unique ability to remove color from a substrate without damaging the substrate. Because of this unique ability bleaches are often incorporated into cleaning compositions as a stain remover. However, most bleaching agents are unstable in typical cleaning compositions due to the alkaline conditions and/or the presence of free moisture.

Various attempts have been made to create a source of bleach which would be stable in cleaning compositions including numerous attempts to encapsulate the bleach in various coating compounds. Unfortunately, the encapsulated bleaches developed so far are either (i) substantially unstable in highly alkaline environments such as found in solid cast detergents, (ii) difficult to manufacture, and/or (iii) prohibitavely expensive to manufacture.

Accordingly, a substantial need exists for an inexpensive, easily manufactured source of bleach that is stable in a highly alkaline environment.

SUMMARY OF THE INVENTION

I have discovered a source of bleach which can remain stable for extended periods of time in a highly alkaline environment. The source of bleach comprises a bleach core encapsulated by an inner coating of a chemically compatible, separating compound and an outer coating of a water soluble cellulose ether selected from the group consisting of ($C_{1-4}$) alkyl celluloses, carboxy $C_{1-4}$) alkyl celluloses, hydroxy $C_{1-4}$) alkyl celluloses, carboxy ($C_{1-4}$) alkyl hydroxy ($C_{1-4}$) alkyl celluloses, ($C_{1-4}$) alkyl hydroxy ($C_{1-4}$) alkyl celluloses and mixtures thereof.

I have discovered that while a bleach core can be effectively protected against an alkaline environment by a single coating of one of the listed water soluble cellulose ethers, the cellulose ether can itself, under the proper conditions, react with and deactivate the bleach core. Accordingly, I have found it preferable to employ an inner coating of a chemically compatable compound to separate the bleach core from the cellulose ether outer coating.

As utilized herein, including the claims, "inner coating" refers to that coating layer in physical contact with the core material.

DETAILED DESCRIPTION OF THE INVENTION INCLUDING A BEST MODE

My stable bleaching composition comprises a bleach core encapsulated in an inner coating of a bleach compatable separating compound and an outer coating of a water soluble cellulose ether.

BLEACHING AGENT

Bleaches suitable for use as the core component include any of the well known bleaching agents capable of removing stains from such substrates as dishes, flatware, pots and pans, textiles, countertops, appliances, flooring, etc. without significantly damaging the substrate. A nonlimiting list of such bleaches includes active halogen releasing bleaches such as hypocchlorites, chlorites, chlorinated phosphates, chloroisocyanates, chloroamines etc.; and peroxide compounds such as hydrogen peroxide, perborates, percarbonates etc. Preferred bleaches include those bleaches which liberate an active halogen species such as $Cl^-$, $Br^-$, $OCl^-$, or $OBr^-$ under conditions normally encountered in typical cleaning processes. Most preferably, the bleaching agent releases $Cl^-$ or $OCl^-$. A nonlimiting list of useful chlorine releasing bleaches includes calcium hypochlorite, lithium hypochlorite, chlorinated trisodium phosphate, sodium dichloroisocyanurate, potassium dichloroisocyanurate, [(monotrichloro)-tetra(monopotassium dichloro)]pentaisocyanurate, monochloroamine, dichloroamine, trichloromelamine, sulfondichloro-amide, 1,3-dichloro-5,5-dimethyl hydantoin, n-chloroammeline, n-chlorosuccinimide, n,n'-dichloroazodicarbonimide, n,n-chloroacetyl urea, n,n'-dichlorobiuret, chlorinated dicyanamide, trichlorocyanuric acid, and hydrates thereof.

Because of their low cost and high bleaching efficiency the most preferred bleaching agents are the alkali metal salts of chloroisocyanurates and the hydrates thereof.

SEPARATING COMPOUNDS

Compounds suitable for use as the inner coating component include any compound which is solid at those temperatures likely to be encountered during storage of the encapsulated bleach (i.e. −5° to 50° C.), is chemically compatible with (i.e. does not react with) either the bleaching agent core or the water soluble cellulose ether outer coating, and is capable of separating the bleaching agent from the cellulose ether so as to prevent deactivation of the bleach by the cellulose ether. Useful separating compounds include specifically but not exclusively water insoluble compounds such as $C_{11-30}$ fatty acids, waxes and water soluble compounds such as alkyl sulfonates, detergent builders and detergent fillers. Because of their ability to readily release the bleach core under conditions typically encountered during detergent use, the water soluble compounds are preferred. Most preferably, the separating compound is an inorganic detergent builder or filler useful in the cleaning composition into which the bleach is to be employed. A nonlimiting list of such detergent builders and fillers includes inorganic compounds such as sodium sulfate, sodium chloride, tetrasodium pyrophosphate, alkali metal silicates, tetrapotassium pyrophosphate, pentasodium tripolyphosphate, pentapotassium tripolyphosphate, sodium sequicarbonate potassium sequicarbonate, phytates, etc. Because of their low cost, ease of availability, ease of use and efficient detergent building properties the inner coating compound preferably comprises a mixture of sodium sulfate and a trppolyphosphate.

WATER SOLUBLE CELLULOSE ETHERS

Cellulose is a liner polymer of anhydroglucose units held together by glucosidic linkages. Each anhydroglucose unit contains three hydroxyl groups—one primary and two secnndary. Cellulose derivatives such as cellulose ethers are formed by reaction of the cellulose with a chemical reagent at these hydroxyl groups. For example, hydroxyethylcellulose can be prepared by the reaction of alkali cellulose with ethylene oxide in the presence of isopropanol, tert-butanol or acetone in accordance with the following equation:

$$R_{cellulose}OH + CH_2{-}CH_2 \xrightarrow{NaOH} R_{cellulose}OCH_2CH_2OH$$
$$O$$

Cellulose derivatives useful as the outer coating component in the present invention are the water soluble cellulose ethers selected from the group consisting of ($C_{1-4}$) alkyl cellulose, carboxy ($C_{1-4}$) alkyl cellulose, hydroxy ($C_{1-4}$) alkyl cellulose di($C_{1-4}$) alkyl carboxy ($C_{1-4}$) hydroxy ($C_{1-4}$) cellulose, ($C_{1-4}$) alkyl hydroxy ($C_{1-4}$) alkyl cellulose and mixtures thereof. For reasons of superior bleach stabilizing performance and ease of application, the preferred cellulose ethers are the hydroxy ($C_{1-4}$) alkyl celluloses with the most preferred cellulose ethers being hydroxyethylcellulose and hydroxy-propylcellulose.

In most commercially available cellulose derivatives, some of the hydroxyl groups are not substituted. The number of unsubstituted hydroxyl groups is known as the degree of substitution (DS) and is designated by a number from 0 to 3 which represents the average number of hydroxyl groups, of the three available in the anhydroglucose unit, that have been substituted.

A special problem arises in the expression of degree of substitution for hydroxyalkyl derivatives because each time a hydroxyalkyl substituent is added, a new reactive hydroxyl group is formed and the number of reactive hydroxyl sites dees not change. The result is the formation of side chains, as shown below:

$$R_{cellulose}OH + CH_2CH_2 \longrightarrow R_{cellulose}OCH_2CH_2OH$$
$$O$$

$$R_{cellulose}OCH_2CH_2OH + CH_2CH_2 \longrightarrow$$
$$O$$
$$R_{cellulose}OCH_2CH_2OCH_2CH_2OH$$

To describe the extent of the formation of side chains the term MS has been coined. MS is defined as the number of moles of reagent (i.e. ethylene oxide) combined per anhydroglucose unit.

The ratio of DS to MS is an indication of the average length of the side chains developed. The DS, MS and ratio of DS to MS can affect the chemical properties of the cellulose derivative and only those cellulose ethers that have a DS, MS and DS:MS which result in a water soluble compound may be usefully employed in the present invention.

The DS of several useful cellulose ethers are set forth below:

TABLE 1

| Cellulose | Typical DS | Preferred DS |
|---|---|---|
| Hydroxymethyl | 0–2.6 | 1.3–2.6 |
| Hydroxyethyl | 0–3 | 1.2–3 |
| Hydroxypropyl | 1.4–3 | 1.4–3 |
| Carboxymethyl | 0.4–1.4 | 0.7–0.9 |

The composition can comprise about 20 to 90 wt-%, preferably about 40 to 70 wt-% bleach core, about 5 to 60 wt-%, preferably about 10 to 50 wt-% separating compound inner coating and about 1 to 25 wt-%, preferably about 2 to 10 wt-% water soluble cellulose ether outer coating.

While not intending to be limited thereby I believe that the water soluble cellulose ethers described herein are capable of protecting a bleaching agent core from deactivation in an alkaline environment because the cellulose ethers are water insoluble when in the presence of at least about 10–50 wt-% inorganic salts such as sodium chloride, sodium sulphate, sodium perborate, etc. (i.e. thoee conditions typically encountered in solid detergents) and water soluble only when the wt-% of inorganic salt falls outside these levels (i.e. those conditions typically encountered during use of the detergent).

ENCAPSULATION PROCEDURE

The bleach may be encapsulated in any convenient manner capable of ensuring complete coating of the bleach. Obtaining a complete protective coating with the cellulose ether is simplified by the tendency of cellulose ethers to naturally form a nonporous, evenly distributed coating on a particle. For reasons of low manufacturing cost and ease of manufacture the bleach is preferably encapsulated in a fluidized bed as set forth in detail in the Examples. Briefly, the separating composition is dissolved in an appropriate solvent, such as water when water soluble, to form an inner coating solution; the water soluble cellulose ether dissolved in water to form an outer coating solution; the bleach particles fluidized in a fluidized bed apparatus, the inner coating solution sprayed onto the fluidized particles and dried, and the outer coating solution sprayed on the fluidized particles and dried.

EXAMPLE I

Into a 32 liter container was placed 5.96 Kg granular sodium sulfate, 1.62 Kg sodium tripolyphosphate and 23.78 Kg water to form a first coating solution.

Into a fluidized bed was placed 14.59 Kg CDB-56, a granular dichloroisocyanurate dihydrate purchased from FMC and now available from Olin Corporation. The CDB-56 was fluidized with air and the bed heated to 68°–74° C. The entire amount of first coating solution was sprayed onto the CDB-56 granules through a Gustav Schlick Nozzle Model 941, at an atomization air pressure of 40 psig, to form once coated CDB-56 particles.

Into the now empty 32 liter container was placed 1.14 Kg KLUCEL J, a hydroxypropylcellulose purchased from Hercules, Inc., and 34.47 Kg water to form a second coating solution. The bed temperature was adjusted to 71°–72° C. and the entire amount of second coating solution sprayed onto the once coated CDB-66 particles through the Gustav Schlick nozzle to form twice coated, protectively encapsulated CDB-56 particles. The bed temperature was then adjusted to 74° C. and the protectively encapsulated CDB-56 particles dried. The process yielded 23.15 Kg of protectively encapsulated CDB-56 particles comprising 60 wt-% core of CDB-56, 35 wt-% first coat of a mixture of 75 wt-% sodium sulfate and 25 wt-% sodium tripolyphosphate hexahydrate and 5 wt-% second caat of KLUCEL J.

EXAMPLE II

Into a 32 liter container was placed 5.96 Kg granular sodium sulfate, 1.62 Kg sodium tripolyphosphate and 23.78 Kg water to form a first coating solution.

Into a fluidized bed was placed 13.43 Kg CDB-56, a granular dichloroisocyanurate dihydrate purchased from FMC and now available from Olin Corporation. The CDB-56 was fluidized with air and the bed heated to 72°-74° C. The entire amount of first coating solution was sprayed onto the CDB-56 granules through a Gustav Schlick Nozzle Model, 941 at an atomized air pressure of 40 psig, to form once CDB-56 coated particles.

Into the now empty 32 liter container was placed 2.27 Kg KLUCEL J, a hydroxypropylcellulose purchased from Hercules, Inc., and 70.94 Kg water to form a second coating solution. The bed temperature was adjusted to 69°-71° C. and the entire amount of second coating solution sprayed onto the once coated CDB-56 particles through the Gustav Schlick nozzle to form twice-coated, protectively encapsulated CDB-56 particles. The bed temperature was then adjusted to 74° C. and the protectively encapsulated CDB556 particles dried. The process yielded 20.14 Kg of protectively encapsulated CDB-56 particles comprising 55 wt-% core of CBB-56, 35 wt-% first coat of a mixture of 75 wt-% sodium sulfate and 25 wt-% sodium tripolyphosphate hexahydrate and 10 wt-% second coat of KLUCEL J.

EXAMPLE III

Into a 32 liter container was paaced 7.26 Kg sodium sulfate, 2.42 Kg sodium tripolyphosphate and 30.36 Kg water to form a first coating solution.

Into a fluidized bed was placed 12.25 Kg CDB-56, a granular dichloroisocyanurate dihydrate purchased from FMC and now available from Olin Corporation. The CDB-56 was fluidized with air and the bed heated to 63°-71° C. The entire amount of first coating solution was sprayed onto the CDB-56 granules through a Gustav Schlick Nozzle Model 941, at an atomized air pressure of 40 psig, to form once coated CDB-56 particles.

Into the now empty 32 liter container was placed 1.13 Kg KLUCEL J, a hydroxypropylcellulose purchased from Hercules, Inc., and 35.51 Kg water to form a second coating solution. The bed temperature was adjusted to 48°-52° C. and the entire amount of second coating solution sprayed onto the once coated CDB-56 particles through the Gustav Schlick nozzle to form twice-coated, protectively encapsulated CDB-56 particles. The bed temperature was then adjusted to 71° C. and the protectively encapsulated CDB-56 particles dried. the process yielded 21.95 Kg of protectively eccapsulated CDB-56 particles comprising 50 wt-% core of CDB-56, 45 wt-% first coat of a mixture of 71 wt-% sodium sulfate and 29 wt-% sodium tripolyphosphate hexahydrate and 5 wt-% second coat of KLUCEL J.

EXAMPLE IV

Into a 32 liter container was placed 2.38 Kg granular sodium sulfate, 0.79 Kg sodium tripolyphosphate hexahydrate and 9.50 Kg water to form a first coating solution.

Into a fluidized bed was placed 5.83 Kg CDB-56, a granular dichloroisocyanurate dihydrate purchased from FMC and now available from Olin Corporation. The CDB-56 was fluidized with air heated to 61° C. The entire amount of first coating solution was sprayed over the spray period onto the CDB-56 granules through a Gustav Schlick Nozzle Model 941 to at an atomization air pressure of 30 psi to form once coated CDB-56 particles.

Into the now empty 32 liter container was placed 0.45 Kg of a blend of 66 Wt-% Lr Natrosol 250 and 34 Wt-% Natrosol 250, both of which are hydroxyethylcelluloses purchased from Hercules, Inc., and 22.7 Kg water to form a second coating solution. The bed temperature was adjusted to an average of 70° C. and the entire amount of second coating solution sprayed over the spray period onto the once coated CDB-56 particles through the Gustav Schlick nozzle to form twice coated, protectively encapsulated CDB 56 particles. The bed temperature was then adjusted to 74° C. and the protectively encapsulated CDB-56 particles dried. The process yielded 8.89 Kg of protectively encapsulated CDB-56 particles comprising 60 wt-% core of CDB-56, 35 wt-% first coat of a mixture of 75 wt-% sodium sulfate and 25 wt-% sodium tripolyphosphate hexahydrate and 5 wt-% second coat of hydroxyethylcellulose.

EXAMPLE V

Into a 32 liter container was placed 2.38 Kg granular sodium sulfate, 0.79 Kg sodium tripolyphosphate hexahydrate and 9.5 Kg water to form a first coating solution.

Into a fluidized bed was placed 5.83 Kg CDB-56, a granular dichloroisocyanurate dihydrate purchased from FMC and now available from Olin Corporation. The CDB-56 was fluidized with air heated to an average of 62° C. The entire amount of first coating solution was sprayed over the spray period onto the CDB-56 granules through a Gustav Schlick Nozzle Model 941, at an atomization air pressure of 30 psi to form once CDB-56 coated particles.

Into the now empty 32 liter container was llaced 0.45 Kg Methocel type F4M, a hydroxypropylmethylcellulose, a methylcellulose purchased from Dow Chemical, Inc., and 22.7 Kg water to form a second coating solution. The bed temperature was adjusted to an average of 71° C. and the entire amount of second coating solution sprayed over the spray period onto the once coated CDB-56 particles through the Gustav Schlick nozzle to form twice-coated, protectively encapsulated CDB-56 particles. The protectively encapsulated CDB-56 particles were then dried. The process yielded 8.87 Kg of protectively encapsulated CDB-56 particles comprising 60 wt-% core of CDB-56, 35 wt-% first coat of a mixture of 75 wt-% sodium sulfate and 25 wt-% sodium tripolyphosphate hexahydrate and 5 wt-% second coat of hydroxypropylmethylcellulose.

EXAMPLE VI

Into a 32 liter container was placed 2.38 Kg granular sodium sulfate, 2.38 Kg sodium tripolyphosphate hexahydrate and 9.5 Kg water to form a first coating solution.

Into a fluidized bed was placed 5.83 Kg CDB-56, a granular dichloroisocyanurate dihydrate purchased from FMC and now available from Olin Corporation. The CDB-56 was fluidized with air heated to 65° C. The entire amount of first coating solution was spraeed over the spray period onto the CDB-56 granules through a Gustav Schlick Nozzle Model 941, at an atomization air pressure of 30 psi to form once coated CDB-56 particles.

Into the now empty 32 liter container was placed 4.5 Kg CMC-CLT, a sodium carboxymethylcellulose purchased from Hercules, Inc., and 22.7 Kg water to form a second coating solution. The bed temperature was adjusted to an average of 71° C. and the entire amount of second coating solution sprayed over the spray period onto the once coated CDB-56 particles through the Gustav Schlick nozzle to form twicecoated, protectively encapsulated CDB-56 particles. The protectively encapsulated CDB-56 particles were dried. The process yielded 8.98 Kg of protectively encapsulated CDB-56 particles comprising 60 wt-% core of CDB-56, 35 wt-% first coat of a mixture of 75 wt-% sodium sulfate and 25 wt-% sodium tripolyphosphate hexahydrate and 5 wt-% second coat of sodium carboxymethyl cellulose.

Example VII

Into a laboratory beaker, equipped with a stirring means and a heating means, was placed 234.9 grams of substantially dimineralized water followed by 356.7 grams anhydrous sodium metasilicate. The contents of the reaction vessel were heated to an average temperature of 77° C. and held at that temperature for 70 minutes to form hydrated metasilicate. The heating means was then removed from the reaction vessel and the temperature of the hydrated metadilicate allowed to fall below 65° C. A premix of 2.2 grams of mono and di alkyl acid phosphate esters rich in $C_{16}$, 13.8 grams of nonionic ethylene propylene oxide block copolymers terminated in propylene oxide and 399.4 grams of hydrated sodium tripolyphosphate containing 19.4 wt-% water of hydration was added to the hydrated metasilicate to form a slurry. The slurry was then thoroughly mixed and cooled to 56° C. 97.5 grams of the slurry was then poured into a 0.1 liter container simultaneously with 2.5 grams of the encapsulated bleach made in accordance with Example I. The contents of the container were quickly agitated for about 10 seconds and then solidified by cooling.

The percent active chlorine remaining in the composition after storage at 100° Fahrenheit for 2 and 4 weeks was titrationally determined to be 88.4 and 90.0% respectively.

EXAMPLE VIII

Into a laboratory beaker, equipped with a stirring means and a heating means, was placed 234.9 grams of substantially dimineralized water followed by 356.7 grams anhydrous sodium metasilicate. The contents of the laboratory beaker were heated to an average temperature of 78° C. and held at that temperature for 69 minutes to form hydrated metasilicate. The heat source was then removed from the reaction vessel and the temperature of the hydrated metasilicate allowed to fall below 66° C. A premix of 2.2 grams of mono and dialkyl acid phosphate ester rich in $C_{16}$, 13.8 grams of nonionic ethylene propylene oxide block copolymers terminated in propylene oxide and 399.4 grams hydrated sodium tripolyphosphate containing 19.4 wt-% water of hydration was added to the hydrated metasilicate to form a slurry. This slurry was then thoroughly mixed and cooled to 53° C. 97.5 grams of the slurry was then poured into a 0.1 liter container simultaneously with 2.5 grams of the encapsulated bleach made in accordance with Example II. The contents of the container were quickly agitated for about 10 seconds and then solidified by cooling. TThe percent active chlorine remaining in the composition after storage at 100° F. for 2 and 4 weeks was titrationally determined to be 82.2% and 84.5% respectively.

EXAMPLE IX

Into a laboratory beaker, equipped with a stirring means and a heating means, was placed 234.9 grams of substantially dimineralized water followed by 356.7 grams anhydrous sodium metasilicate. The contents of the reaction vessel were heated to an average temperature of 78° C. and held at that temperature for 57 minutes to form hydrated metasilicate. The heat source was then removed from the reaction vessel and the temperature of the hydrated metasilicate allowed to fall below 66° C. A premix of 2.2 grams of mono and dialkyl acid phosphate esters rich in $C_{16}$, 13.8 grams of nonionic ethylene propylene oxide block copolymers terminated in propylene oxide and 399.4 grams of hydrated sodium tripolyphosphate containing 19.4 wt-% water of hydration wwas added to the hydrated metasilicate to form a slurry. This slurry was then thoroughly mixed and cooled to 52° C. 997.5 grams of the slurry was then poured into a 0.1 liter container simultaneously with 2.5 grams of the encapsulated bleach made in accordance with Example III. The contents of the container were quickly agitated for about 10 seconds and then solidified by cooling.

The percent active chlorine remaining in the composition after storage at 100° F. for 2 and 4 weeks was titrationally determined to be 89.4% and 89.2% respectively.

EXAMPLE X

Into a laboratory beaker, equippe with a stirring means and a heating means, was placed 234.9 grams of substantially dimineralized water followed by 356.7 grams anhydrous sodium metasilicate. The contents of the reaction vessel were heated to an average temperature of 86° C. and held at that temperature for 80 minutes to form hydrated metasilicate. The heating means was then removed from the reaction vessel and the temperature of the hydrated metasilicate allowed to fall below 63° C. A premix of 2.3 grams of mono and dialkyl acid phosphate esters rich in $C_{16}$, 13.9 grams of nonionic ethylene propylene oxide block copolymers terminated in propylene oxide and 399.2 grams hydrated sodium tripolyphosphate containing 19.4 wt% water was added to the hydrated metasilicate to form a slurry. This slurry was then thoroughly mixed and cooled to 56° C. 97.5 grams of the slurry was then poured into a 0.1 liter container simultaneously with 2.5 grams of the encapsulated bleach made in accordance with Example IV. The contents of the container were quickly agitated for about 10 seconds and then solidified by cooling.

The percent active chlorine remaining in the composition after storage at 100° F. for 2 and 4 weeks was titrationally determined to be 91.5% and 84.6% respectively.

EXAMPLE XI

Into a laboratory beaker, equipped with a stirring means and a heating means, was placed 234.9 grams of substantially dimineralized water followed by 356.7 grams anhydrous sodium metasilicate. The contents of the reaction vessel were heated to an average temperature of 73° C. and held at that temperature for 62 minutes to form hydrated metasilicate. The heat source was then removed from the reaction vessel and the temperature of the hydrated metasilicate allowed to fall below 61° C. A premix of 2.3 grams of mono and dialkyl acid phosphate ester rich in $C_{16}$, 13.8 grams of nonionic ethylene propylene oxide block copolymers terminated in propylene oxide and 399.2 grams hydrated sodium tripolyphosphate contiining 19.4 wt-% water of hydration was added to the hydrated metasilicate to form a slurry. This slurry was then thoroughly mixed and cooled to 50° C. 97.5 grams of the slurry was then poured into a 0.1 liter container simultaneously with 2.5 grams of the encapsulated bleach made in accordance with Example V. The contents of the container were quickly agitated for about 10 seconds and then solidified by cooling.

The percent active chlorine remaining in the composition after storage at 100° F. for 2 weeks was titrationally determined to be 84.1%.

EXAMPLE XII

Into a laboratory beaker, equipped with a stirring means and a heating means, was placed 234.9 grams of substantially dimineralized water followed by 356.7 grams anhydrous sodium metasilicate. The contents of the reaction vessel were heated to an average temperature of 77° C. and held at that temperature for 65 minutes to form hydrated metasilicate. The heat source was then removed from the reaction vessel and the temperature of the hydrated metasilicate allowed to fall below 60° C. A premix of 2.3 grams of mono and dialkyl acid phosphate ester rich in $C_{16}$, 13.9 grams of nonionic ethylene propylene oxide block copolymers terminated in propylene oxide and 399.2 grams hydrated sodium tripolyphosphate containing 19.4 wt-% water of hydration was added to the hydrated metasilicate to form a slurry. This slurry was then thoroughly mixed and cooled to 50° C. 97.5 grams of the slurry was then poured into a 0.1 liter container simultaneously with 2.5 grams of the encapsulated bleach maee in accordance with Example VI. The contents of the container were quickly agitated for about 10 seconds and then solidified by cooling.

The percent active chlorine remaining in the composition after storage at 100° F. for 2 weeks was titrationally determined to be 92%.

I claim:

1. An encapsulated bleach particle, comprising:

(a) a bleaching agent core;

(b) an inner coating of a separating compound in an amount sufficient to retard any chemical interaction between the bleaching agent core and an outer coating compound; and (c) an outer coating of encapsulating amount of a water soluble cellulose ether compound selected from the group consisting of ($C_{1-4}$) alkyl cellulose, carboxy ($C_{1-4}$) alkyl cellulose, hydroxy ($C_{1-4}$) alkyl cellulose, carboxy ($C_{1-4}$) alkyl hydroxy ($C_{1-4}$) alkyl cellulose, $C_{1-4}$) alkyl hydroxy ($C_{1-4}$) alkyl cellulose, and mixtures thereof.

2. The encapsulated particle of claim 1 wherein the bleaching agent is a source of active halogen.

3. The encapsulated particle of claim 2 wherein the bleaching agent is a source of active chlorine.

4. The encapsulated particle of claim 3 wherein the bleaching agent is an alkali metal dichloroisocyanurate, and hydrates thereof.

5. The encapsulated particle of claim 1 wherein the separating compound is a water soluble detergent builder or filler.

6. The encapsulated particle of claim 5 wherein the detergent builder or filler is sodium sulfate, sodium chloride, a condensed phosphate or a combination thereof.

7. The encapsulated particle of claim 5 wherein the water soluble cellulose ether is a hydroxy ($C_{1-4}$) alkyl cellulose.

8. The encapsulated particle of claim 7 wherein the hydroxy ($C_{1-4}$) alkyl cellulose is hydroxypropylcellulose.

9. The encapsulated particle of claim 7 wherein the hydroxy ($C_{1-4}$) alkyl cellulose is hydroxyethylcellulose.

10. The encapsulated particle of claim 7 wherein the hydroxy ($C_{1-4}$) alkyl cellulose has a DS of about 0.7 to 3.0.

11. The encapsulated particle of claim 8 wherein the hydroxypropylcellulose has aDDS of about 1.4 to 3.0.

12. The encapsulated particle of claim 9 wherein the hydroxyethylcellulose has a DS of about 1.2 to 3.0.

13. The encapsulated particle of claim 1 wherein the encapsulated particle comprises about 20–90 wt-% core, about 50–60 wt-% inner coating and about 1–25 wt-% outer coating.

14. The encapsulated particle of claim 1 wherein the encapsulated particle comprises about 40–70 wt-% core, about 10–50 wt-% inner coating compound and about 2–10 wt-% outer coating compound.

15. An encapsulated bleach particle, comprising:

(a) about 20–90 wt-% core of an active chlorine source;

(b) about 5–60 wt-% inner coating of a detergent builder or filler surrounding and in physical contact with the core; and (c) about 1–25 wt-% outer encapsulating coating of a hydroxy ($C_{1-4}$) alkyl cellulose which is physically separated from the core of active chlorine source by the inner coating.

16. The particle of claim 13 wherein the particle comprises:

(a) about 40–70 wt-% core;

(b) about 10–50 wt-% inner coating of sodium sulfate, sodium chloride, a condensed phosphate or a combination thereof; and (c) about 2–10 wt-% outer coating of hydroxypropylcellulose.

17. The particle of claim 13 wherein the particle comprises:

(a) about 40–70 wt-% core;

(b) about 10–50 wt-% inner coating of sodium sulfate, sodium chloride, a condensed phosphate or a combination thereof; and (c) about 2–10 wt-% outer coating of hydroxyethylcellulose.

* * * * *

UNITED STATES PATENT AND TRADEMARK OFFICE

CERTIFICATE OF CORRECTION

PATENT NO. : 4,830,773

DATED : May 16, 1989

INVENTOR(S) : Keith E. Olson

It is certified that error appears in the above-identified patent and that said Letters Patent is hereby corrected as shown below:

On the front page under "OTHER PUBLICATIONS," before "Natrosol," delete the word "Bulleting" and insert --Bulletin--.

In the abstract, lines 3-4, delete "compatable" and insert --compatible--.

In column 1, line 25, delete "prohibitavely" and insert --prohibitively--.

In column 1, line 49, delete "compatable" and insert --compatible--.

In column 1, lines 59-60, delete "compatable" and insert --compatible--.

In column 2, line 2, delete "hypocchlorites" and insert --hypochlorites--.

In column 2, lines 17-18, delete "n-chloroammeline" and insert --N-chloroammeline--.

In column 2, line 18, delete "n-chlorosuccinimide" and insert --N-chlorosuccinimide--.

In column 2, lines 18-19, delete "n,n'-dichloroazodicarbonimide" and insert --N,N'-dichloroazodicarbonimide--.

In column 2, line 19, delete "n,n-chloroacetyl" and insert --N,N-chloroacetyl--.

In column 2, line 19, "delete "n,n'-dichlorobiuret" and insert --N,N'-dichlorobiuret--.

In column 2, lines 44-45, delete "preferered" and insert --preferred--.

In column 2, line 53, delete "sequicarbonate" and insert --sesquicarbonate--.

UNITED STATES PATENT AND TRADEMARK OFFICE

CERTIFICATE OF CORRECTION

PATENT NO. : 4,830,773

DATED : May 16, 1989

INVENTOR(S) : Keith E. Olson

It is certified that error appears in the above-identified patent and that said Letters Patent is hereby corrected as shown below:

In column 2, line 54, delete "sequicarbonate" and insert --sesquicarbonate--.

In column 2, line 54, delete "phytates" and insert --hydrates--.

In column 2, line 58, delete "trppolyphosphate" and insert --tripolyphosphate--.

In column 2, line 61, delete "liner" and insert --linear--.

In column 2, line 64, delete "secnndary" and insert --secondary--.

In column 3, lines 18-19, delete "hydroxy-propylcellulose" and insert --hydroxypropylcellulose--.

In column 3, line 32, delete "dees" and insert --does--.

In column 4, line 9, delete "sulphate" and insert --sulfate--.

In column 4, line 10, delete "thoee" and insert --those--.

In column 4, line 61, delete "caat" and insert --coat--.

In column 5, line 5, delete "Schlick Nozzle Model, 941" and insert --Schlick Nozzle Model 941--.

In column 5, line 16, delete "CDB556" and insert --CDB-56--.

In column 5, line 19, delete "CBB-56" and insert --CDB-56--.

In column 5, line 24, delete "paaced" and insert --placed--.

In column 5, line 45, before "process" delete "the" and insert --The--.

In column 5, lines 45-46, delete "eccapsulated" and insert --encapsulated--.

In column 5, line 62, delete "to at" and insert --at--.

In column 6, line 6, delete "CDB 56" and insert --CDB-56--.

UNITED STATES PATENT AND TRADEMARK OFFICE

CERTIFICATE OF CORRECTION

PATENT NO. : 4,830,773

DATED : May 16, 1989

INVENTOR(S) : Keith E. Olson

It is certified that error appears in the above-identified patent and that said Letters Patent is hereby corrected as shown below:

In column 6, line 30, delete "llaced" and insert --placed--.
In column 6, line 56, delete "spraeed" and insert --sprayed--.
In column 6, line 68, delete "twicecoated" and insert --twice-coated--.
In column 7, line 11, delete "dimineralized" and insert --demineralized--.
In column 7, line 17, delete "metadilicate" and insert --metasilicate--.
In column 7, line 39, delete "dimineralized" and insert --demineralized--.
In column 7, line 58, delete "TThe" and insert --The--.
In column 7, line 66, delete "dimineralized" and insert --demineralized--.
In column 8, line 10, delete "wwas" and insert --was--.
In column 8, line 12, delete "997.5" and insert --97.5--.
In column 8, line 24, delete "equippe" and insert --equipped--.
In column 8, line 26, delete "dimineralized" and insert --demineralized--.

UNITED STATES PATENT AND TRADEMARK OFFICE

CERTIFICATE OF CORRECTION

PATENT NO. : 4,830,773

DATED : May 16, 1989

INVENTOR(S) : Keith E. Olson

It is certified that error appears in the above-identified patent and that said Letters Patent is hereby corrected as shown below:

In column 8, line 53, delete "dimineralized" and insert --demineralized--.

In column 8, line 64, delete "contiining" and insert --containing--.

In column 9, line 12, delete "dimineralized" and insert --demineralized--.

In column 9, line 29, delete "maee" and insert --made--.

In column 10, line 20, delete "aDDS" and insert --a DS--.

Signed and Sealed this

Fifteenth Day of January, 1991

*Attest:*

HARRY F. MANBECK, JR.

*Attesting Officer*

*Commissioner of Patents and Trademarks*